US005911190A

United States Patent [19]

Lochtefeld et al.

[11] Patent Number: 5,911,190

[45] Date of Patent: Jun. 15, 1999

[54] BOAT ACTIVATED WAVE GENERATOR

[75] Inventors: Thomas J. Lochtefeld, La Jolla; Charles E. Sauerbier, Arroyo Grande, both of Calif.

[73] Assignee: Light Wave, Ltd.

[21] Appl. No.: 08/893,701

[22] Filed: Jul. 11, 1997

Related U.S. Application Data

[62] Division of application No. 08/475,092, Jun. 7, 1995, Pat. No. 5,664,910.

[51] Int. Cl.[6] ..... B63B 1/24

[52] U.S. Cl. ..... 114/274; 405/79

[58] Field of Search ..... 405/79; 114/274, 114/126, 271, 56, 67 R, 42, 41, 40; 210/242.2, 242.3

[56] References Cited

U.S. PATENT DOCUMENTS

| | | | |
|---|---|---|---|
| Re. 25,165 | 5/1962 | Pulsifier . | |
| 998,437 | 7/1911 | Wieland . | |
| 1,006,118 | 10/1911 | Napier . | |
| 1,184,207 | 5/1916 | Perrault . | |
| 2,151,836 | 3/1939 | Bugatti . | |
| 2,414,480 | 1/1947 | Morrill . | |
| 2,584,347 | 2/1952 | Hazard . | |
| 2,983,508 | 5/1961 | Modine . | |
| 3,101,691 | 8/1963 | Wendt . | |
| 3,115,860 | 12/1963 | Payne . | |
| 3,139,055 | 6/1964 | Nutting . | |
| 3,199,483 | 8/1965 | Ellzey . | |
| 3,216,390 | 11/1965 | Molotzak . | |
| 3,343,513 | 9/1967 | Bader . | |
| 3,481,297 | 12/1969 | Mantle . | |
| 3,613,622 | 10/1971 | Bueller . | |
| 3,638,598 | 2/1972 | Viad . | |
| 3,688,730 | 9/1972 | Ortlieb et al. . | |
| 3,763,810 | 10/1973 | Payne . | |
| 3,977,347 | 8/1976 | With . | |
| 3,998,176 | 12/1976 | Stout et al. . | |
| 4,002,131 | 1/1977 | Mangrum . | |
| 4,003,325 | 1/1977 | Allen | 114/67 A |
| 4,056,074 | 11/1977 | Sachs . | |
| 4,067,286 | 1/1978 | Stout et al. . | |
| 4,190,619 | 2/1980 | Cherne | 261/92 |
| 4,224,889 | 9/1980 | Spiegel . | |
| 4,233,920 | 11/1980 | Wood et al. . | |
| 4,351,262 | 9/1982 | Matthews . | |
| 4,361,102 | 11/1982 | Wood et al. . | |
| 4,437,842 | 3/1984 | Connor . | |
| 4,458,622 | 7/1984 | Anderson . | |
| 4,484,534 | 11/1984 | du Boullay . | |
| 4,491,518 | 1/1985 | Benaroya et al. | 210/177 |
| 4,498,409 | 2/1985 | Edel . | |
| 4,507,094 | 3/1985 | Hennebutte . | |
| 4,606,291 | 8/1986 | Hoppe . | |
| 4,669,408 | 6/1987 | Schad . | |
| 4,821,663 | 4/1989 | Schad . | |
| 5,000,110 | 3/1991 | Moore . | |
| 5,088,433 | 2/1992 | Osawa et al. . | |
| 5,178,090 | 1/1993 | Carter . | |
| 5,263,430 | 11/1993 | Monfort . | |

(List continued on next page.)

FOREIGN PATENT DOCUMENTS

| | | | |
|---|---|---|---|
| 0061645 | 10/1982 | European Pat. Off. | 114/271 |
| 2554409 | 5/1985 | France | 114/126 |

*Primary Examiner*—Sherman Basinger
*Attorney, Agent, or Firm*—Dickinson Wright PLLC

[57] ABSTRACT

The present invention is primarily a boat activated wave generator that can be operated in a deep body of water. The wave generator is pulled or otherwise pushed through the water, and has wave generating portions that scoop up water, to form wave shapes thereon, upon which various surfing and skimming maneuvers can be performed. The shape of the wave generator is such that it forms wave shapes, and various wave formations, and remains in substantial equilibrium in the water. The wave generator also forms wakes, and enhances the boat's wake, such that various skimming maneuvers, i.e., wake-boarding and water skiing can be performed.

20 Claims, 8 Drawing Sheets

U.S. PATENT DOCUMENTS 5,282,436 2/1994 Hansen .
5,315,951 5/1994 Finkl .
5,362,269 11/1994 Leach .
5,447,459 9/1995 Hammond .
5,481,996 1/1996 Osawa et al. .
5,482,485 1/1996 Ball .
5,549,071 8/1996 Pigeon et al. .
5,611,295 3/1997 Stables .

BOAT ACTIVATED WAVE GENERATOR

RELATED APPLICATIONS

This application is a divisional of U.S. application Ser. No. 08/475,092, filed Jun. 7, 1995, now U.S. Pat. No. 5,664,910.

FIELD OF THE INVENTION

The present invention relates to a generator for forming waves, and in particular, to a generator activated by a boat in a deep water environment.

BACKGROUND OF THE INVENTION

Surfing, as a sport, has attracted enthusiasts all over the world, and many of them travel long distances to locations where ideal surfing conditions exist. Particularly prized by expert surfers are the waves called "the chute" or "the pipeline", that is, waves which move with sufficient velocity and height that, when they encounter an upwardly sloping bottom of certain configuration, curl forward over the advancing base of the wave to form a tunnel. Expert surfers can ride inside or at the mouth of the wave formation and move laterally across the face of the wave, while seeking to keep pace with the formation of the tunnel without being caught in the collapsing portion thereof.

The formation of such ideal waves under natural conditions requires a comparatively rare combination of factors, including wind of a certain constancy of velocity and direction, and waves of a certain velocity, direction and height, approaching a shore having a certain bottom slope and configuration. Very few locations in the world have such favorable conditions and combination of characteristics. Even in those areas where favorable land and water conditions exist, the most favorable surfing conditions may occur only during limited times of the year and only during ideal weather conditions. For these reasons, surfing has become a sport which eludes most individuals, and all but the most dedicated and enthusiastic surfers rarely have an opportunity to surf an ideal tunnel wave. Those that do, including most expert surfers, typically have to travel thousands of miles to reach ideal surfing locations, many of which are in remote areas.

Recently, sheet wave water rides, such as those known as the Flow-Rider™, have emerged to provide even the most inexperienced surfer an opportunity to ride a wave. These water rides, which simulate a substantially perfect wave, have become popular and have been installed at a number of water amusement parks. Individuals no longer have to travel thousands of miles to experience the thrill of surfing.

Nevertheless, at the present time, these water rides have been installed only at certain locations, and because they are extremely popular, people generally have to wait in long lines to participate. Individuals sometimes have to wait for a substantial time, making it difficult to not only ride the water ride, but particularly to practice and learn the skills necessary to become a competent surfer.

Recent developments in water sports activity has also seen an increasing popularity in the sport of wake-boarding, which is an off-shoot of the sport of water skiing. Wakeboarders are pulled behind a boat in much the same manner as water skiing. The wake-board and the wakeboarders'maneuvers, however, are more akin to those of surfing and snowboarding. Wakeboarders make use of the wake of the boat as a ramp in which to launch a maneuver. The size and shape of the wake are an integral part of the wake-boarders sporting canvas. At the present time, other than modifying the ballast and trim of the wake-generating boat, nothing exists to improve the boat's wake, or, generate a new and enhanced wake-like wave.

What is needed, then, is a semi-portable wave generating device that can be operated by the surfer at virtually any convenient time at almost any suitable location. This need is satisfied by a boat activated wave generating device capable of forming surfable and/or wake-boardable waves thereon, which can be operated and powered by a power boat in much the same fashion as conventional water skiing equipment.

SUMMARY OF THE INVENTION

The present invention represents a substantial improvement over prior wave generating devices in that the present invention is boat activated and can be used at the convenience of the operator. The present invention can form a wave upon which surfing and/or wake-boarding maneuvers can be performed, at virtually any time in virtually any deep body of water. All that is needed is a boat, a deep body of water, such as a lake, the wave generating device and fair weather.

The present invention is essentially a wave generating device that is powered by a motor boat. It can be operated by being pulled from the back end of the boat, or otherwise affixed to the boat hull. The wave generating device comprises twin wave generating members which, as they move through the water, scoop up water to form curling wave shapes thereon, or other wave and/or wake formations.

In the embodiment that is pulled by a boat, the device floats in water, and is pulled through the water from the stem of the boat by one or more ropes or cables. The rope(s) is connected to the device at a forward extending center portion. The twin curved surfaces or wave generating members extend laterally outward and slightly rearward on either side of the center portion. The upper surfaces of each of the twin members are curved in both horizontal and vertical directions so that as water is scooped up by the device, onto, over and across the curved surfaces, wave shapes are formed thereon.

In the embodiment that is affixed to the boat hull, the wave generating device is more or less an extension of the boat hull itself, preferably at the side or rear of the boat, wherein the twin members extend laterally outward from the boat hull, scooping up water on either side of the boat. In either embodiment, the twin members are designed to cut through water, each member having laterally extending leading portions that help scoop water upward onto the twin members.

The upper surface of the twin members of the wave generating device each have a concave shape, not only vertically, but also horizontally, or laterally, so that a theoretical infinitesimal body of water, moving along the face of the twin members, encounters a force, which is primarily vertical and forward, as it travels along the curved face of the twin members. This force, or pressure field, accelerates the water, forcing it upward and forward, above the surrounding body of water and the face of the twin members, so that the force of gravity can overcome its upward and forward momentum and cause it to fall in a curving arc, back to the base of the advancing wave. If the forward speed of the water is sufficient, its path will form a loop. A sheet of water, which the wave generating device pares as it moves forward, may form a tunnel shape, at the mouth of or within which a rider can maneuver and perform surfing maneuvers thereon.

The ideal surface condition of the water is preferably calm, but even when the water surface is not calm, such as in windy weather, the wake formed by the boat as it moves through the water can, in some instances, provide a basis for forming a steady flow of water onto the twin wave generating members. So long as the wake stays relatively steady, the water that the device travels through can be stabilized.

Because the present invention is primarily boat activated, it is important that the wave generating device be positioned in the water so that, as it moves through the water, a steady flow of water flows upward onto the upper surface of the twin members. For this reason, the depth at which the wave generating device, and more particularly, the leading portions of the twin members, is maintained relative to the water surface, is important. If the leading portions of the twin members are maintained too low, excess water may flow onto the twin members, as the wave generating device moves through the water. Excess water may actually prevent the formation of a curling wave. If too much water flows onto the twin members, the wave generating device may cut too deeply into the water, causing the device to dive, and possibly abruptly stopping its forward progress. If not enough water is allowed to flow over the twin members, on the other hand, as when the wave generating device merely skims or planes along the surface of the water, a sufficient flow of wave forming water may not be created at all. If this occurs, no ridable wave would be formed.

In an embodiment that is pulled by a boat, the buoyancy characteristics of the device, along with its weight and shape, help contribute to maintaining the twin members at a substantially constant depth relative to the water surface. In any embodiment that is attached to the boat hull, the boat itself helps to maintain the device substantially level in the water.

During operation, and in particular, at high speeds, the shape of the wave generating device, from a hydrodynamic standpoint, contributes to maintaining the device at a substantially constant depth in the water. As the wave generating device accelerates, hydrodynamic forces ultimately act upon the device, which must be counteracted in order for the device to remain stable in the water. The shape and relative angles of inclination of the forward extending portion, the twin generator members, and the bottom surface of the device, which come into contact with the water as the device accelerates, are designed to help maintain the wave generating device at a substantial hydrodynamic equilibrium.

Various hydrodynamic forces act upon the device during acceleration. Water flowing over the device, for instance, causes a downward reaction, as water is lifted onto the twin members. The bottom surface of the device, on the other hand, tends to skim, or otherwise plane, over the water, which, in combination with the buoyancy of the device, pushes the device relatively upward. The taught rope extending from the boat, depending on its vertical placement, can also provide a lifting effect.

To maintain the wave generating device during operation at a substantially constant depth, the upward forces are necessarily countered by the downward forces. More specifically, the tendency of the device to plane, or be lifted, is offset by an opposite tendency of the device to be pushed down by the mass of elevated water. Although other factors, such as weight, buoyancy, overall shape and size of the device, also have an effect on maintaining the device at a substantially constant depth, during operation, these factors must be taken into consideration so that the varying impact of hydrodynamic forces are minimized.

In the preferred embodiment, the wave generating device has a front leading portion that extends across the entire front edge of the device. In this embodiment, the entire leading portion helps lift water onto the device as it moves through the water. The entire leading portion across the front of the wave generating device is wedge-shaped in cross section to enable the leading portion to cut into and through the water, and allow a sheet flow of water to flow onto the device. In this embodiment, maintenance of depth relies heavily on the buoyancy of the materials used, along with the weight and shape of the wave generating device. In another embodiment, the device is similar in shape to the preferred embodiment, but is more elongated, forming a narrower "V" shape from above. The elongated shape of this embodiment produces less drag, and thus, can be pulled faster, with substantially less power than the preferred embodiment. This embodiment, however, rather than producing surfable wave shapes, as discussed, produces wakes, or enhanced wakes, around, over or through which wakeboarding maneuvers can be performed.

These embodiments can be further stabilized by the addition of optional stabilizing devices. For instance, to stabilize the device in rough water, a disc-like stabilizer, that skims at or slightly below the surface of the water, can be attached in front of the wave generating device. The disc-like stabilizer, which is connected to the wave generating device by a stabilizing rod, helps to maintain the wave generating device level and at a substantially constant depth in the water. Various other shapes, such as a torpedo-shape, can also be used.

To help keep the wave generating device aligned in the direction of travel, it is preferable that the device be symmetrical, with the extended twin members being of equal size and shape on both sides of the center portion. Grooves, or scores, or even rudders, or one large rudder, can also be provided longitudinally along the bottom surface of the device to direct water from the front to the back, which also helps keep the device aligned. The rope or ropes that pull the device can also be connected to the forward-most center portion of the device, which helps to self-align the device as the boat pulls the device. In addition, two ropes can be used to further keep the wave generating device aligned in the direction of travel.

In another embodiment, as discussed, the twin wave generating members may be attached to the boat hull itself. In this embodiment, the boat, from which the twin members extend laterally, helps to stabilize the wave generating device in the water. Other embodiments, such as those that move on rails, and are mechanically pulled, are also within the contemplation of the present invention.

The invention which has been summarized above is described in more detail in the following detailed drawings and description.

DETAILED DESCRIPTION OF THE INVENTION

The present invention is primarily a wave generating device 1 that is boat activated, such that it can be pulled by, or otherwise affixed to, a motor boat 2 in a deep water environment, wherein, as the boat is operated, the device moves through the water, scooping up water to form wave shapes, such as tunnel waves, spilling waves, or, in some embodiments, enhanced wakes. Depending on the type of wave generating device being used, and consequently, the wave shapes that are formed, a rider can ride on, or otherwise maneuver about, the wave, or wake, performing various skimming, skiing, wake-boarding and/or surfing maneuvers thereon, which can, in some cases, simulate the thrill of surfing, or, in other cases, enhance the sport of wake-boarding.

While there are several embodiments disclosed herein, the basic concept of the present invention is a wave generating device that is boat activated, and which, by the power of the boat, is moved through the water, such that it scoops up water to form wave shapes thereon. The preferred embodiment and several others are designed to create surfable wave shapes in the water, while other embodiments are designed to create ridable wakes, and enhanced wakes. While each of these embodiments may have common characteristics, there are also characteristics that are different and unique to each of the particular embodiments. The present invention is intended to include all of the embodiments and characteristics disclosed herein, as well as other embodiments and characteristics, which may not have been disclosed, which are nevertheless substantially consistent with the operation and function of the disclosed embodiments.

The Preferred Embodiment

Figure 1:
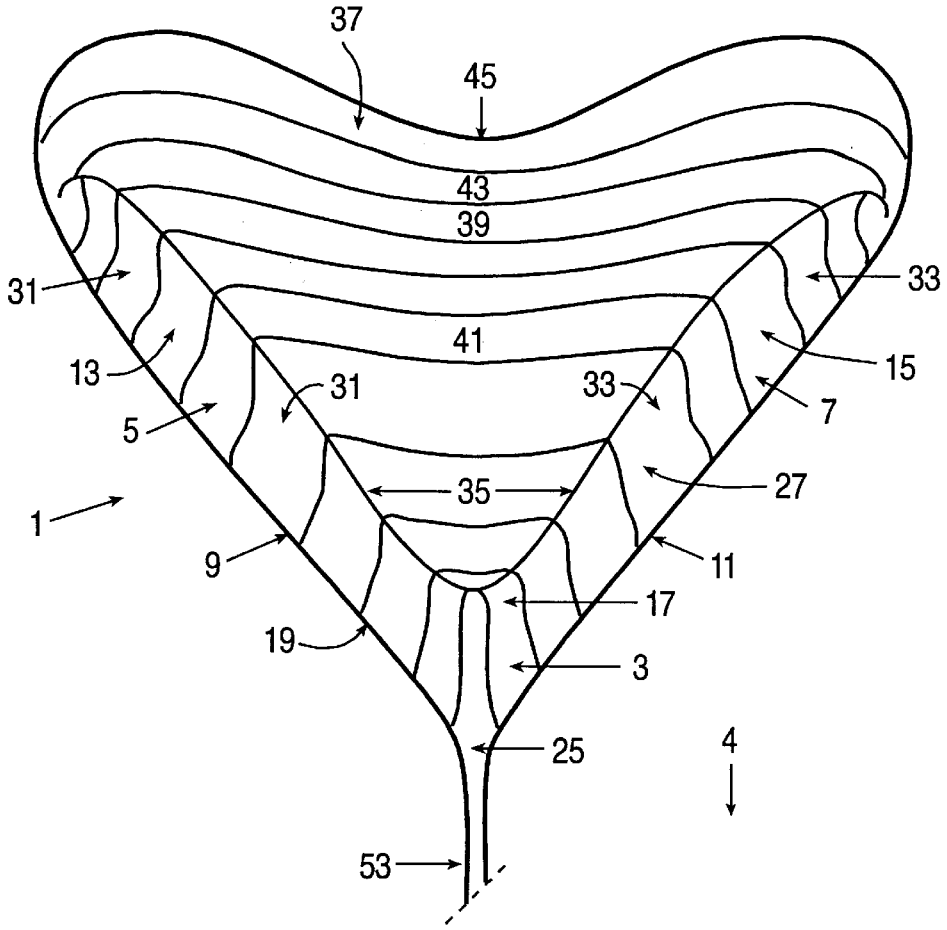
FIG. 1 is a top view of the preferred embodiment of the present invention.
Figure 2:
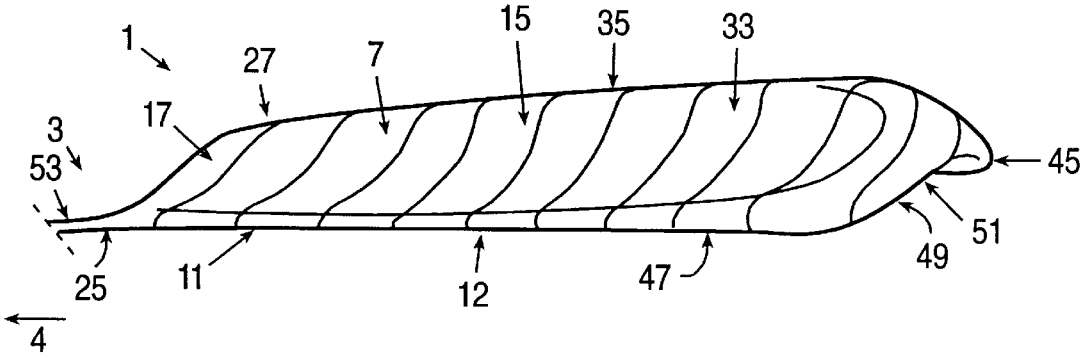
FIG. 2 is a side view of the preferred embodiment of the present invention.
Figure 3:
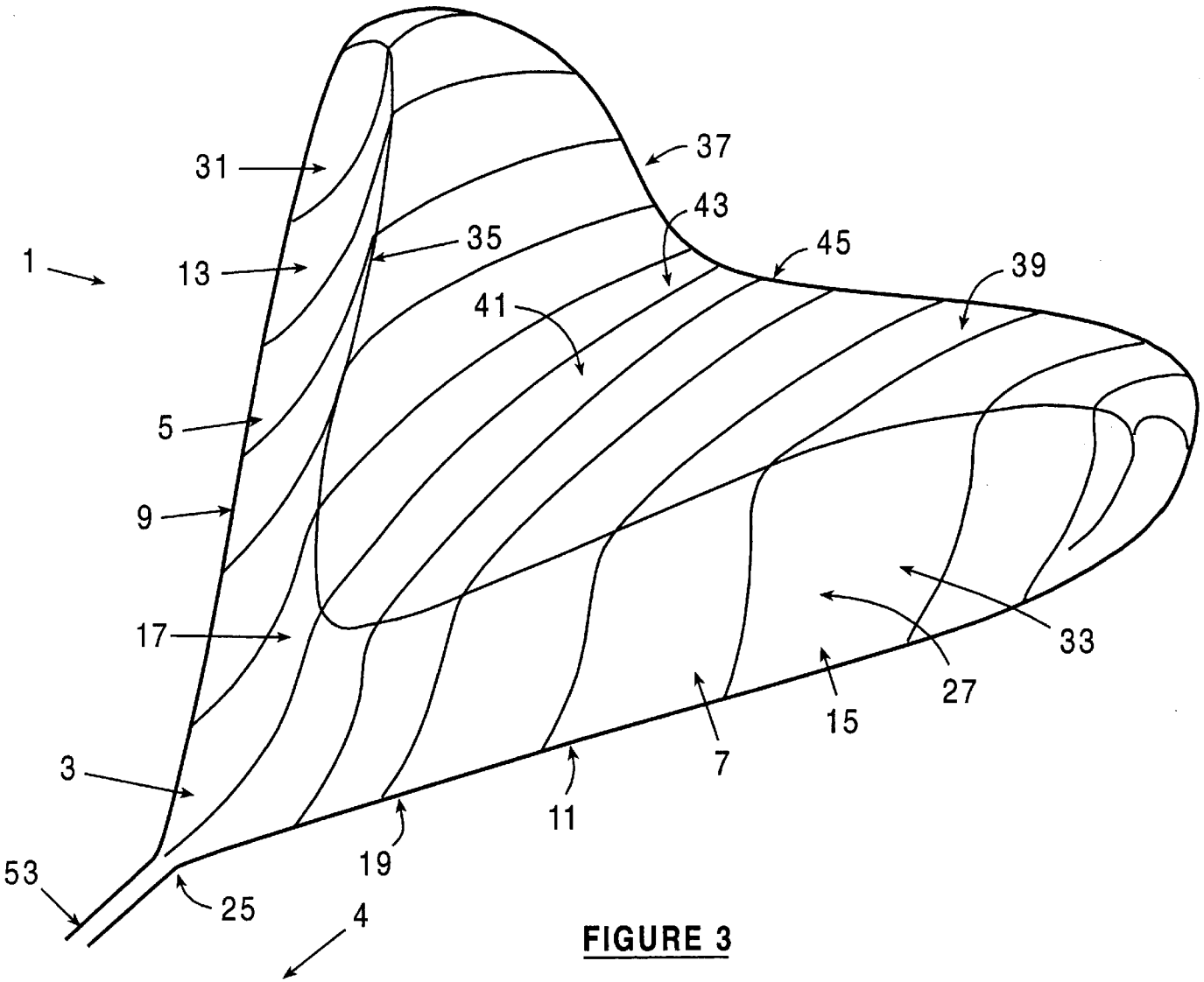
FIG. 3 is a perspective view of the preferred embodiment of the present invention.

The boat activated wave generating device 1, of the preferred embodiment, as shown in FIGS. 1–3, is substantially in the shape of a triangular wing, and has a forward extending center portion 3, from which the device 1 is pulled by the boat 2. For purposes of this application, unless otherwise indicated, "forward" will be the direction that the device 1 travels in the water, as shown by arrow 4, and "rearward" will be the opposite direction.

As shown in FIG. 1, there are two substantially identically shaped wave generating members 5, 7, hereinafter referred to as the "twin members," extending laterally and substantially horizontally at a rearward angle, from either side of the center portion 3, to form a substantial "V" shape from above. Extending substantially horizontally along a forward edge 19 of the device 1, are leading portions 9, 11. The leading portions 9, 11 are preferably, in cross section, in the shape of a flattened wedge, having a forward extending point 25 in front of the forward center portion 3.

Figure 3A:
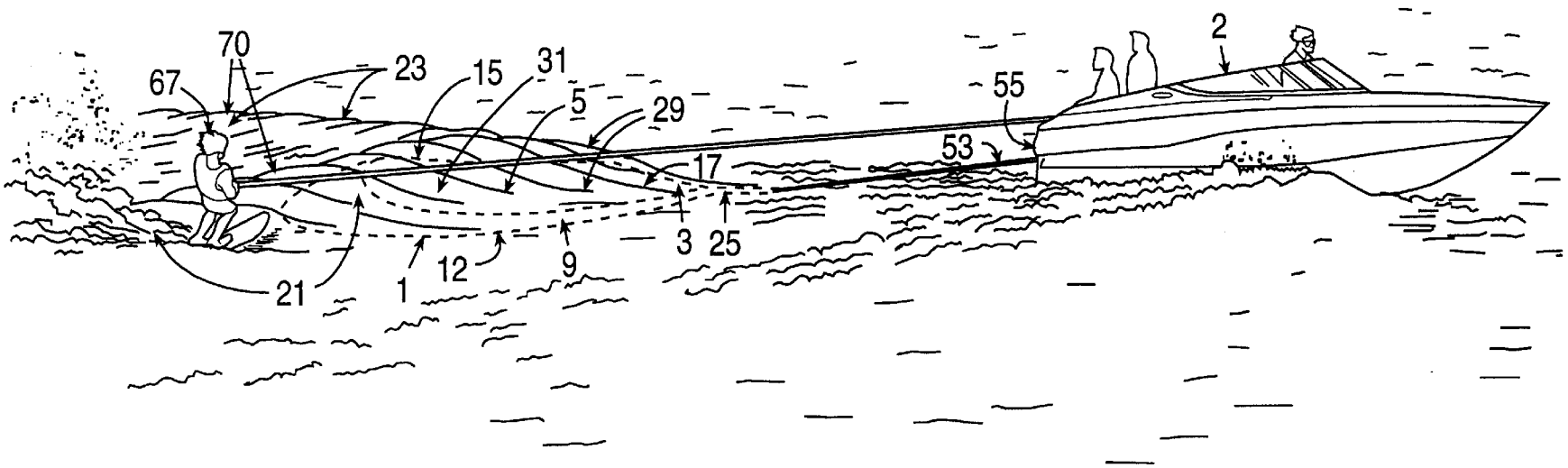
FIG. 3*a* is a side view of the present invention in operation, being pulled by a boat, showing wave shapes that are formed.

In general, as shown in FIG. 3*a*, during operation, the leading portions 9, 11 cut through the water, slightly below surface level, to form a layer, or sheet, of water 29, that flows onto the twin members 5, 7. The leading portions 9, 11 extend substantially along the bottom edge 12 of the device 1, to help lift water 29 in an upward direction onto the twin members 5, 7, such that wave shapes 21, 23 are formed thereon, as shown in FIG. 3*a*. The leading portions 9, 11, however, are preferably substantially dull, and covered with a soft material, as will be discussed, such that if a rider is accidentally struck, the rider will not be injured.

As shown in FIG. 3, formed integrally on the twin members 5, 7 are curved wave generator hulls 13, 15, which extend slightly rearwardly and above the leading portions 9, 11 on either side of the center portion 3. Each of the wave generator hulls 13, 15 preferably has a concave curvature, in both horizontal and vertical directions, as will be discussed, and has outwardly facing curved riding surfaces 31, 33. As shown in FIG. 1, the generator hulls 13, 15 are angled horizontally, with respect to the direction of travel 4, at about a 45 degree angle, although the actual angle can vary between 30 to 50 degrees, or more.

Between and slightly in front of the two generator hulls 13, 15, is a center wave generator hull 17, which extends above and slightly behind the center portion 3, and connects the two generator hulls 13, 15 together at the apex of the "V". The center generator hull 17 extends rearward from the center portion 3 and has a concave curvature in the vertical direction, but in a horizontal direction, has a convex curvature, as can be seen in FIG. 1.

As shown in FIG. 3, the wave generator hulls 13, 15 have an inclined concave curvature which causes water flowing over the riding surfaces 31, 33 to flow in a forward and upward direction, relative to the surrounding water, and in a rearward and upward direction, relative to the riding surfaces 31, 33, as the device moves through the water. The generator hulls 13, 15 are also oriented laterally at an angle, as discussed, which causes the sheet flow of water 29 to flow laterally across the riding surfaces 31, 33, forming separate and substantially identical wave shapes 21, 23, on either side of the center portion 3.

The incline and/or the degree of curvature of the riding surfaces 31, 33, and their lateral orientation, determines the amount of forward and upward momentum exerted on the sheet flow 29, as the device travels through the water, and the size and height of wave shapes 21, 23. If the riding surfaces have a relatively steep incline, and/or a relatively tight curvature (in the vertical direction), for instance, wave shapes 21, 23 are likely to be relatively large and extend relatively high. Conversely, if the riding surfaces have a relatively shallow incline, and/or relatively open curvature, wave shapes 21, 23 are likely to be relatively small. In addition, if the angle of lateral orientation is relatively high, i.e., close to 45 degrees, as in the preferred embodiment, relative to the direction of flow, the sheet flow of water 29 is likely to flow laterally across the riding surfaces, forming wave shapes 21, 23, which move upward and laterally across the riding surfaces 31, 33. If the angle of lateral orientation, on the other hand, is considerably less than 45 degrees, relative to the direction of flow, as in the alternate embodiment, the sheet flow of water 29 will flow relatively rearward, and only slightly forwardly and laterally, forming a relatively rearwardly flowing trajectory, rather than a curling wave.

Collectively, the twin members 5, 7, the generator hulls 13, 15, and 17, and the riding surfaces 31, 33, form a top riding surface 27, which extends substantially across the width of the device. Additional description of wave generator hulls can be found in U.S. Pat. Nos. 4,792,260; 4,954,014; 5,236,280; and in U.S. application Ser. No. 07/722,980, the relevant portions of which are incorporated herein by reference.

In the preferred embodiment, the device 1 is substantially symmetrical in configuration, such that as the device 1 moves through the water, the hydrodynamic forces acting on the device 1 help to keep it aligned in the direction of travel.

That is, the twin members 5, 7 extend substantially identically from either side of the center portion 3, such that the twin members experience substantially identical hydrodynamic forces, which, during operation, tend to stabilize the device in the forward direction. Asymmetrical devices, however, that have other stabilizing means, such as those disclosed herein, which can offset the hydrodynamic forces acting on the twin members, are also within the contemplation of the present invention.

Connecting the generator hulls 13, 15 and 17, is a ridge 35, which extends substantially across the width of the device, separating the top riding surface 27, from a back portion 37, located to the rear of the device. Extending rearward from the ridge 35 on the back portion 37 is a rear stabilizing foil 39, and a concave center area 41 located substantially adjacent and behind the ridge 35. The center area 41 forms a substantially concave channel 43 extending rearward from the ridge 35 to a rear edge 45 of the device 1. This channel 43 helps permit water flowing over the ridge 35 to be channeled properly towards the rear 45 of the device, which further helps to stabilize the device.

Figure 6:
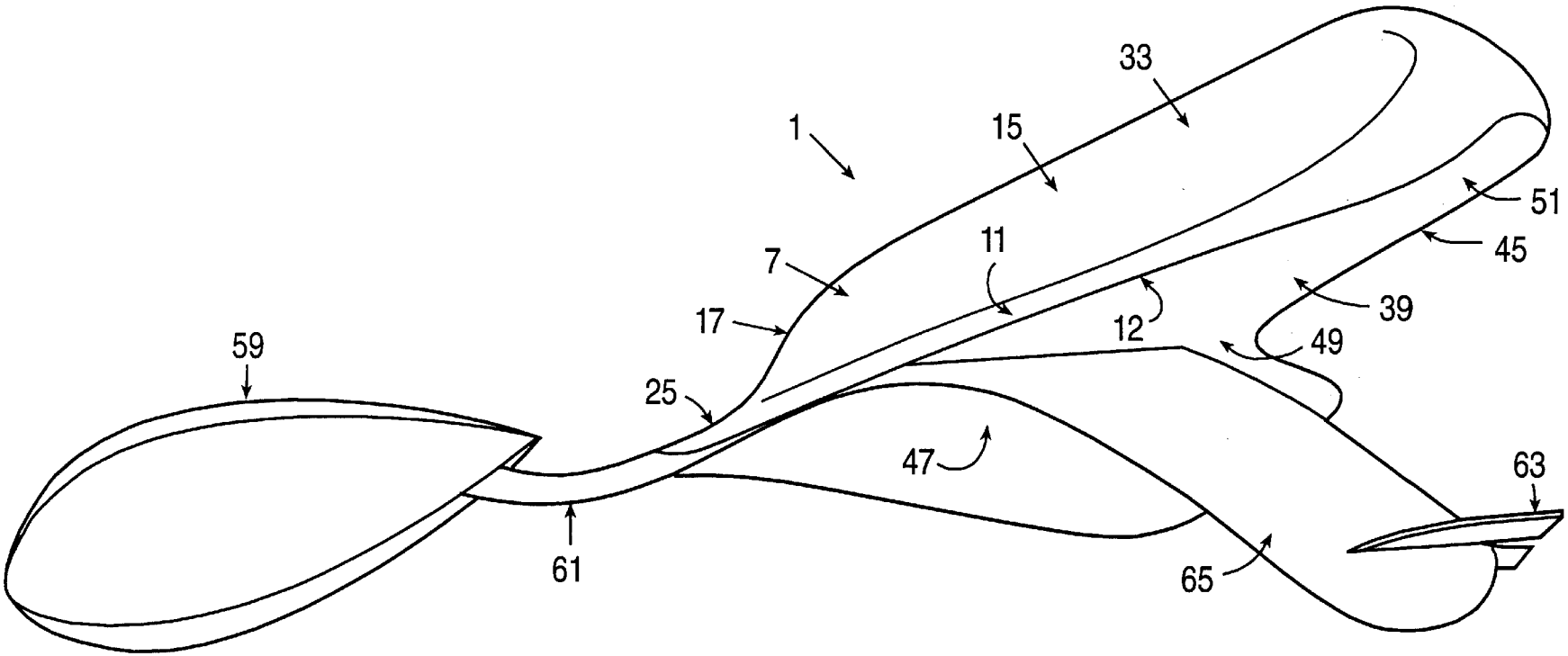
FIG. 6 is a tilted bottom view of the present invention with a torpedo-like stabilizer and an optional center rudder.

A bottom side 47, as partially seen in FIG. 6, is preferably elongated and concave in configuration such that it forms a downward facing channel 49 extending longitudinally in a forward to rearward direction. This orientation of the channel 49 helps to divert water, as the device 1 travels over the water, in a rearward direction, which stabilizes the device in the direction of travel. A rearward portion 51 of the bottom surface 47, which is the underside of the rear stabilizing foil 39, is slightly rearwardly inclined to help water, over which the device travels, to be transitioned smoothly to the rear edge 45 of the device. The bottom surface can also be provided with grooves, ridges, scores, or even a rudder 65, as shown in FIG. 6, extending longitudinally in the fore/aft direction, to further help stabilize the device in the direction of travel. The rudder 65 can be provided with stabilizing wings 63 which further help stabilize the device 1.

Keeping the device 1 substantially level, and the leading portions 9, 11 at a substantially constant depth in the water, is important to the successful formation of wave shapes 21, 23. This is because the depth of the leading portions 9, 11, relative to the water surface level, to the extent the leading portions cut through and lift water onto the twin members 5, 7, determines the thickness and consistency of the sheet flow of water 29, flowing onto the riding surfaces 31, 33.

To form wave shapes 21, 23 upon which surfing maneuvers can be performed, for instance, the thickness of the sheet flow 29 is preferably consistent, although consistency is difficult to achieve, absent ideal water surface conditions. The device is preferably designed so that the leading portions 9, 11 are consistently maintained below the surface of the water, taking into consideration the weight, shape and buoyancy of the device. The depth at which the device travels should also take into consideration the speed at which it travels, and the manner in which it is pulled by the boat, as will be discussed. While the actual depth can vary, the depth should generally be sufficient to form a sheet flow of water 29 on the device, and yet shallow enough that undesirable hydrodynamic drag is reduced, which might otherwise prevent the formation of wave shapes, or, dramatically reduce the speed of travel, and increase the amount of power needed to pull the device through the water.

The buoyancy of the device helps to keep the device afloat in the water when the device is stationary. The buoyancy in effect creates an upward force, which is countered in part by the weight of the device, which provides a downward force component. The upward and downward forces are counterbalanced, in conjunction with the shape of the device, such that the device remains at a substantial equilibrium in the water, which helps to keep the device at a substantially constant depth. The shape of the device, which is substantially wide, also displaces water over a relatively large area, which helps keep the device level in the water, by preventing undesirable tilting, which in turn, helps keep the device at a substantially constant depth.

When the device is accelerated through the water, hydrodynamic forces begin to act upon the device, making it difficult, on the basis of the buoyancy and weight of the device alone, to keep the device in substantial equilibrium. The shape of the device, therefore, in conjunction with its weight and buoyancy, preferably help to stabilize the device in the water, even during rapid acceleration.

Water flowing over the device, for instance, causes a downward force, as water is lifted onto the twin members. The speed at which the device travels also affects the extent to which the water flowing over the device will exert a downward force on the device. The bottom surface of the device, on the other hand, tends to skim, or plane, over the water, which, in combination with the buoyancy of the device, tends to elevate the device in the water. The planing effect which causes the upward force is also a function of the speed of the device. Pulling the device by a rope, depending on the vertical placement of the rope, can also add an upward force component, as the rope becomes taught. Accordingly, the shape of the leading portions, the generator hulls and the bottom surface of the device, which come into contact with the water, and the speed and orientation of the device, contribute to keeping the device in substantial hydrodynamic equilibrium. These characteristics employ the necessary counteracting forces, which offset the upward and downward forces acting on the device, to help minimize the hydrodynamic effects exerted on the device, and to keep the device at a substantially constant depth in the water.

The buoyancy of the device is made possible by the materials used to make the device, by making the device hollow, or by inserting air pockets into the device. Even if the material itself does not float, the device can be made to float by making it hollow, or by adding air pockets. Air pockets of various sizes, and at various locations, can be dispersed within the body of the device, whenever additional buoyancy is needed.

While virtually any type of material used in the manufacture of boats, in general, can be used to manufacture the device, the device 1 is preferably made of a strong, durable, slightly flexible material, such as fiber-glass, wood, metal or carbon graphite composite. The device is also preferably integrally formed, i.e., a fiber-glass shell, and is manufactured by a conventional injection mold process. By integrally forming the device, the device can be made strong enough to withstand the impact of shear, torsion and bending, caused by hydrodynamic forces, which are likely to act on the device during operation. The material should also be slightly flexible so that the device will not cause injury to a rider, who may fall or accidentally be struck by the device during use. The exterior of the device should also be covered by a soft, impact absorbent material, such as foam, or other material, that is easy to apply. In addition, the device should be coated with a water proof, or water-resistant material, such as rubber, which has a low coefficient of friction, and can be formed without seams, so that hydrodynamic drag is minimized. The outer layer or coating can be applied in any conventional manner, such as spray, glue, thermal heating, welding, or other method.

The device is preferably between 5 to 20 feet wide and about 5 to 25 feet long. The preferred size allows for the formation of tunnel wave shapes on the device, and permits up to two riders to ride on the device simultaneously. The preferred size is also large enough that variations in the surface condition of the water will have relatively little effect on the device, hydrodynamically speaking. The device can range in height from between 1 to 5 feet, depending on the overall size of the device, and on the height, size and character of the desired wave shapes. The present invention is intended to be offered in a variety of sizes and shapes so that a variety of wave shapes and boats with varying amounts of power can be accommodated.

Operation of the Preferred Embodiment

Prior to operation, the device 1 is connected to the boat 2 by a rope 53. The rope 53 is attached at its back end to the forward extending center portion 3, and at its forward end to the stern 55 of the boat 2. The rope 53 is preferably attached to the middle of the center portion 3 so that, as the boat pulls the device 1, the rope helps to self-align the wave generating device 1 in the direction of travel. The rope can be attached to the center portion 3 in any conventional manner, such as by a knot, a clamp, or a connecting joint, i.e., a ball and socket. Preferably, the rope is detachable at both the front and back ends, to the boat and generator device 1, respectively, so that the rope can easily be removed when needed.

Dual ropes (not shown) can also be provided, rather than a single rope, which can be connected at two points along the forward extending center portion 3, which can further help self-align the generator device 1 as it is pulled by the boat. The rope 53, or ropes, can be of any conventional type, such as those used in the sport of water skiing, and preferably, is strong, flexible, durable, yet light-weight, and water resistant. For example, the rope can be made of strands of fiber, such as nylon, fiber-glass, steel, etc., and can be coated with water resistant material, such as plastic, rubber, etc., if necessary. The above described manner of connecting the wave generating device 1 to the boat 2 is typical of the connection between not only this embodiment and the boat, but also other boat-pulled embodiments.

Once the device 1 is connected to the boat 2 by the rope 53, the device is preferably aligned in the direction of travel, and floats in a deep body of water, with the leading portions 9, 11 facing forward. The rider, or riders, as the case may be, desiring to surf, positions him/herself on top of the device. Depending on the skill of the rider, the rider can use a surfboard, boogieboard or other skimming device. Wake-boarders, on the other hand, are pulled from behind the boat in a manner similar to water skiers. The rope 53 is preferably taught immediately before use so that a jolt is not caused by acceleration.

Just prior to acceleration, the device is adjusted so that the leading portions 9, 11 of the device are kept level and at a substantially constant depth. This is important so that as the device accelerates and travels through the water, a proper amount of water will be lifted onto the twin members. Getting the proper amount of water to flow initially onto the twin members 5, 7 will make it easier to maintain a steady flow of water thereon.

The device 1 is pulled in the forward direction, as indicated by the arrow 4, by the boat 2, so that the device moves through the water in a forward direction. The device can be accelerated slowly to allow the proper amount of water to flow onto the twin members 5, 7. Unlike the sport of water skiing, where a rider must get "up" as the boat accelerates, the rider of the present invention can position him/herself on the device even before it accelerates.

As the device accelerates, water is scooped up by the leading portions 9, 11, and onto the twin members 5, 7, forming a sheet flow of water 29, which flows onto the top riding surface 27. The generator hulls 13, 15 have a concave curvature, in both horizontal and vertical directions, such that, as the device 1 is pulled through the water, a theoretical infinitesimal body of water, within the sheet of water 29, is acted upon both vertically and horizontally, forcing the infinitesimal body of water to accelerate in a forward and upward direction, above the surrounding body of water. Because the generator hulls 13, 15 are also oriented at an angle relative to the direction of travel, facing outwardly from the center portion 3, the infinitesimal body of water not only flows upward and forward, but also flows laterally across the riding surfaces 31, 33, away from the center portion 3. A portion of the sheet flow 29, however, can flow over the center generator hull 17 toward the rear 45 of the device 1.

To form a tunnel wave, the device must be accelerated with sufficient power to cause the sheet flow of water to flow forward and upward onto the riding surfaces 31, 33, and to create a supercritical flow, relative to the riding surfaces 31, 33, such that gravity can overcome the forward and upward momentum of the sheet flow, causing it to fall in a curling fashion, back onto the advancing sheet flow below. The speed at which the device is pulled determines to a large extent the size and character of the tunnel wave that is formed on the riding surfaces, i.e., the faster the device is pulled, the greater the forward and upward momentum that is created, and therefore, the faster and higher the supercritical sheet flow of water 29 will travel, relative to the riding surfaces. Other factors, such as the depth of the leading portions, the amount of water flowing onto the twin members, the condition of the water surface, and the stability of the wake formed behind the boat, as discussed, will affect the formation of the tunnel wave shapes.

A wake 70 is also formed by the device as it moves through the water, upon which various wake-boarding and/or skimming maneuvers can be performed. The wake forms, in effect, two solitary wave formations, one on each side of the device, trailing off at an angle behind the wave shapes 21, 23, as shown in FIG. 3*a*.

The rider or riders can, once the boat is in motion, maneuver onto the twin members 5, 7, and begin to perform water skimming and/or surfing maneuvers on the wave shapes 21, 23. The device 1 preferably moves through the water with sufficient speed and force to overcome any drag that may result from riders riding on the wave shapes 21, 23. In ideal circumstances, the rider can, due to gravity, ride the wave shapes 21, 23, by reaching a substantial equilibrium, between the downward force exerted by gravity, and the upward momentum exerted by the flow of water 29, on the riding surfaces 31, 33. The rider can also maneuver laterally across the wave shapes, away from the center portion 3, to ride the solitary wave shapes, formed on the wake that trails behind the device in the water. Wake-boarders similarly can maneuver around and/or over the solitary wave shapes, in the manner discussed. The size of the wake 70, and the ability of riders to perform maneuvers thereon, depends on the speed of the device, its size, and the amount of water being displaced. The greater the speed, size and/or displacement, the greater the size of the wake, and the better the chances are of a rider being able to maneuver on the wake.

Water that flows from the riding surfaces 31, 33 is permitted to flow either off to the side of the generator hulls 13, 15, or over the ridge 35, and down onto the center area 41. Because some water flows over the center portion 3 and onto and over the center generator hull 17, a rider can, with enough skill, and under ideal conditions, maneuver from one side of the device, or riding surface, to the other side, or other riding surface, by traversing forward toward the center portion 3, and then cutting across the center portion 3.

In the preferred embodiment, the degree of incline, curvature and orientation of the generator hulls 13, 15, and of the riding surfaces 31, 33, relative to the direction of travel, determine to a large extent the nature and character of the wave shapes that are formed. Wave generating hulls 13, 15 that have only a slight incline, or curvature, as discussed, will form a relatively small, shallow wave shape. Whereas, generator hulls that have a greater incline, or curvature, and/or vertical extension, will form a relatively large, fully developed tunnel wave shape. The degree of incline, curvature and angle of orientation that is to be used in any particular circumstance is a function of various factors, such as those disclosed in the previous patents and applications referred to above.

The power of the boat that is used to pull the device 1 will also determine to what extent the wave generator hulls 13, 15 can form wave shapes 21, 23 thereon. A powerful boat will be required, for instance, to pull a large device, or one that can form a large, tunnel wave, rather than a small, shallow wave. This is because the hydrodynamic drag caused by a relatively large device, or one having a relatively high degree of incline, curvature or angle of orientation, is greater than the drag caused by a relatively small device, or one having a relatively small degree of incline, curvature or angle of orientation.

Additional Stabilizing Devices

In ideal weather conditions, the surface of the water is relatively calm, so that the wave generating device 1 will remain relatively stable in the water. On the other hand, when weather conditions are not ideal, the surface of the water may become rough, or turbulent, which may cause the device to become relatively unstable. Although the wake of the boat, as discussed previously, will help provide a relatively calm surface to some extent, additional stabilizers can be provided to provide additional stabilization.

Figure 4:
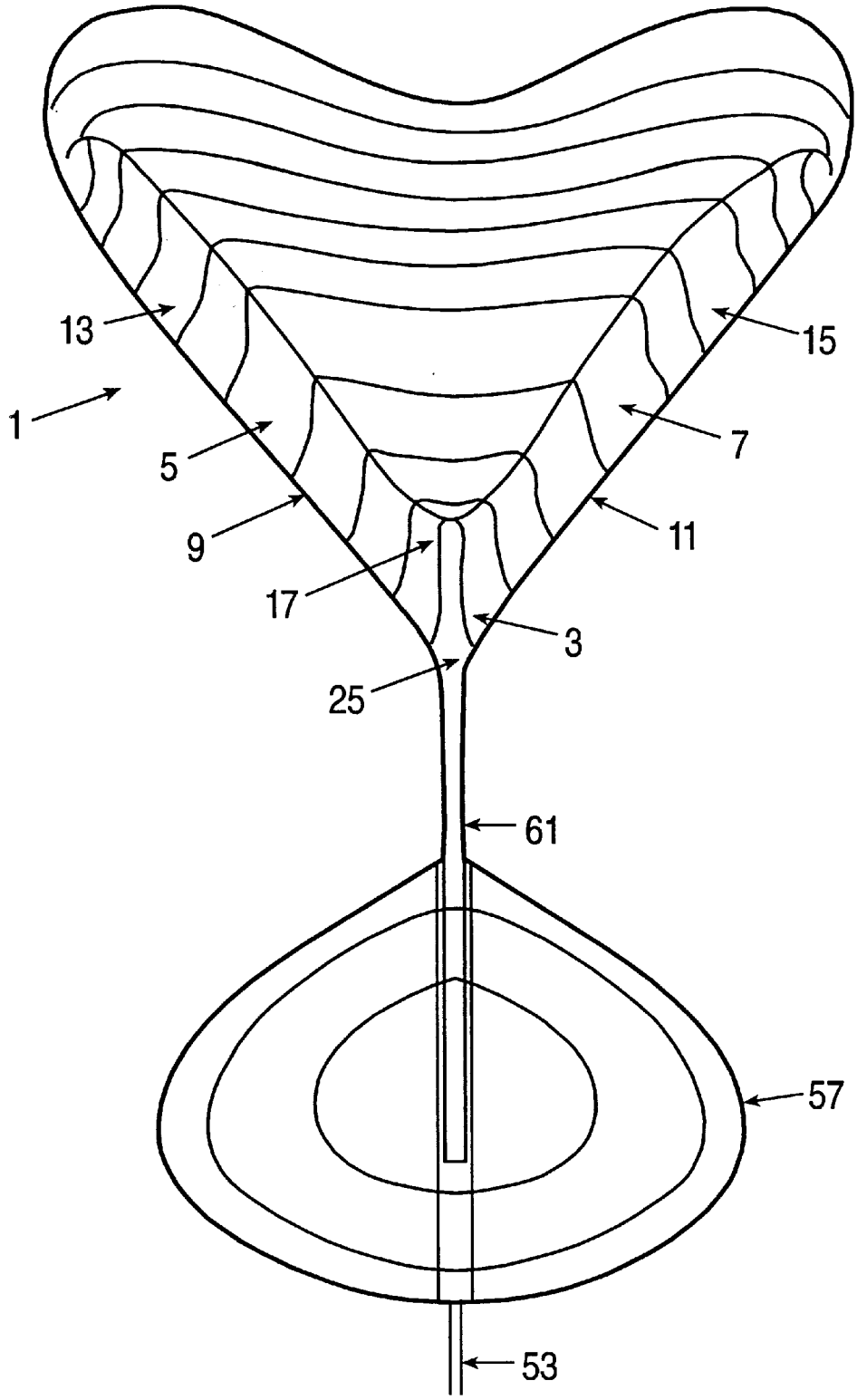
FIG. 4 is a top view of the present invention with a disc-like stabilizer.
Figure 5:
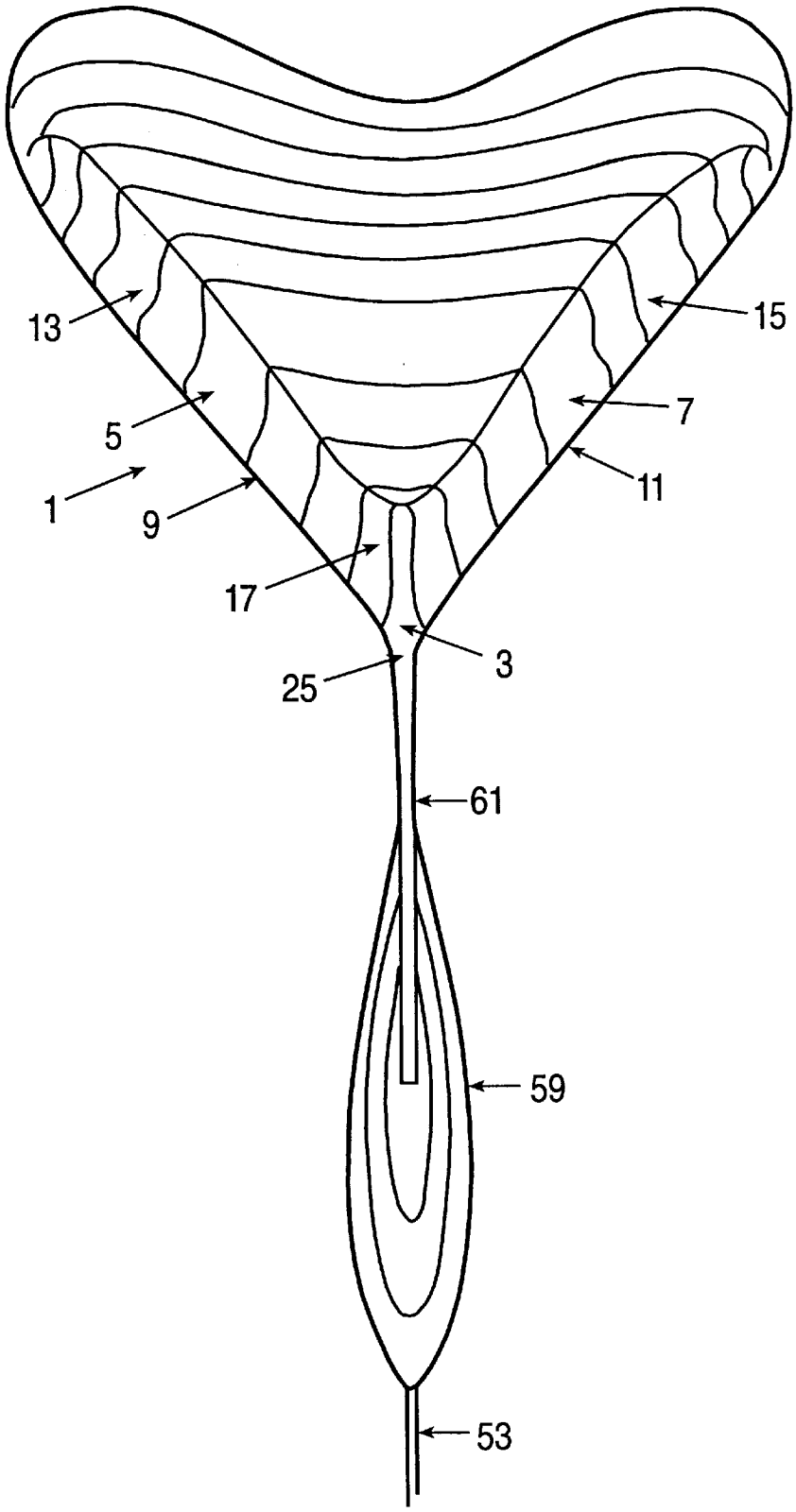
FIG. 5 is a top view of the present invention with a torpedo-like stabilizer.

While the preferred embodiment will adequately perform in conditions that are not too extreme, the present invention contemplates the use of optional stabilizing devices, which will, when necessary, help to keep the device 1 stable, even during relatively rough, turbulent conditions. As shown in FIGS. 4–6, additional stabilizers can be mounted in front of the device, such as a disc-like stabilizer 57, as shown in FIG. 4, or a torpedo-like stabilizer 59, as shown in FIGS. 5–6.

As shown in FIG. 4, the disc-like stabilizer 57 is essentially in the shape of a flattened disc, connected to the device 1 via a connecting rod 61. In this application, the rope 53 is connected to the front of the stabilizer 57, rather than the device, so that the boat pulls the stabilizer 57, which in turn pulls the device 1. The stabilizer 57 is preferably mounted about 2 to 10 feet in front of the device, which is close enough for the stabilizer 57 to have maximum ballasting effect on the device, while far enough that the stabilizer 57 does not interfere with the riders riding on the device 1.

The disc-like stabilizer 57 helps to stabilize the device 1 in the water, in part due to its buoyancy characteristics, and in part due to its ability to plane, or otherwise skim, at or slightly below the surface level of the water, which, through the connecting rod 61, maintains the device 1 at a substantially constant elevation in the water. By maintaining the stabilizer 57 at or near the surface of the water, the stabilizer 57 prevents the device 1 from planing too far upward, or diving too far downward.

The wide flat configuration of the stabilizer 57 also helps reduce the roughness, or turbulence, of water immediately in front of the device, so that, as the device moves through the water, water that eventually flows onto the device will be relatively calm. For this reason, the disc-like stabilizer 57 is preferably about two-thirds the width of the device 1, which adds to its stabilizing effect. Its width, however, should not be much more that, so that undesirable drag is not created by the stabilizer 57.

The connecting rod 61 is preferably made of a strong, durable, light-weight, relatively stiff, although somewhat flexible, material, such as fiber-glass, graphite composite, or steel, etc. The rod 61 is preferably stiff, although flexible, such that the stabilizer 57 can flexibly ballast the device 1. Preferably, the rod 61 is also affixed to the stabilizer 57 and the device 1, so that the connecting joints are relatively stiff.

The materials from which the disc-like stabilizer 57 is made can be the same or similar to the materials from which the device 1 is made. Accordingly, the stabilizer can be hollow, or have air pockets, so that it floats in water. The safety features found in the device 1, as discussed above, however, are not as important to the stabilizer 57.

As shown in FIGS. 5–6, the torpedo-like stabilizer 59 is substantially in the shape of a torpedoe and is attached, via a connecting rod 61, in much the same manner as the disc-like stabilizer 57. Much like the stabilizer 57, the torpedo-like stabilizer 59 helps to stabilize the device 1 by skimming at or slightly below the surface level of the water, ballasting the device 1. Its more streamlined configuration, however, creates less drag than the disc-like stabilizer 57, which makes it more suitable for high speed applications. The torpedo-like stabilizer 59 can be made from the same materials, and operate essentially in the same manner, as the disc-like stabilizer 57.

The Alternate Embodiment

Figure 7:
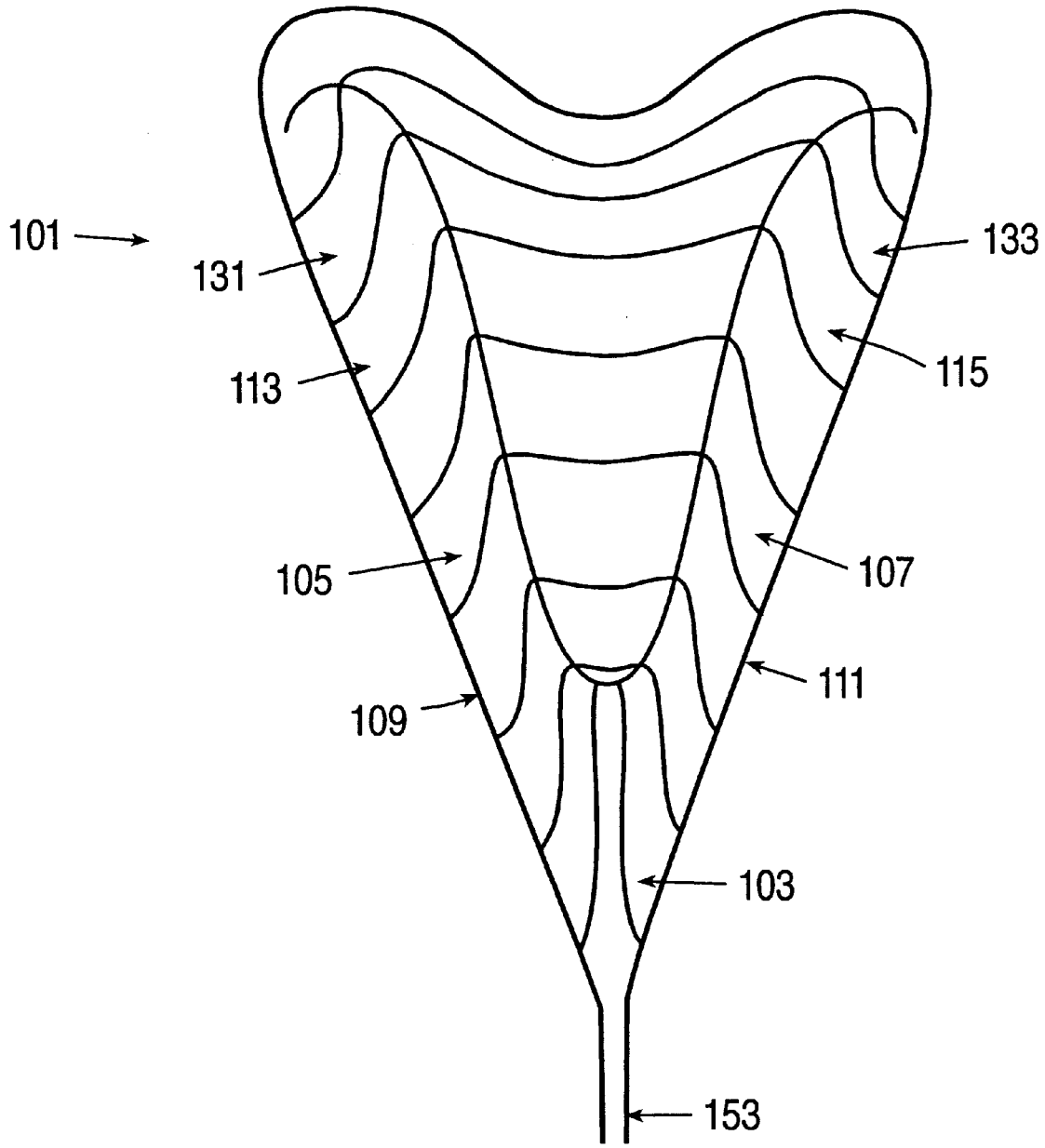
FIG. 7 is a top view of an alternate embodiment.

The alternate embodiment, awake enhancement device 101, as shown in FIG. 7, is pulled by a boat in the same manner as the preferred embodiment. The wake enhancement device 101, is substantially similar in shape, in many respects, to the preferred embodiment, except that the device 101 is more elongated, forming a narrower, taller "V" shape from above. The relatively narrow configuration of the device 101 makes it possible for the device 101 to cut through the water more easily than the preferred embodiment, creating less drag, and making it advantageous for high speed applications. This makes it possible for the device 101 to be used in the sports of wake-boarding and water skiing, which require that the boat travel at relatively high speeds.

As in the preferred embodiment, the wake enhancement device 101 is substantially symmetrical, and has a forward extending center portion 103, onto which a rope 153 is attached, which provides the same self-aligning benefits of the preferred embodiment. That is, by pulling the device from a forward extending center portion 103, the device is self-aligned in the direction of travel.

While the generator hulls 113, 115, have a concave curvature, as seen in FIG. 7, horizontally and vertically, similar to the preferred embodiment, the angle of orientation, horizontally, of the generator hulls 113, 115, is considerably less, with respect to the direction of flow, than the preferred embodiment, at about 15 to 30 degrees. Accordingly, the wake enhancement device 101 forms wakes, or other wave formations, rather than surfable wave shapes 21, 23, upon which riders can ride. For instance, the wake enhancement device can enhance an existing wake, such as the one formed by the boat 2, about, over or through which wakeboarding and/or water skimming maneuvers can be performed, which significantly increases the challenge and/or diversity of those sports.

The relatively elongated orientation of twin members 105, 107, and wave generator hulls 113, 115, causes water flowing onto the twin members to be accelerated upward, but not necessarily forwardly, or laterally, as in the preferred embodiment. That is, when an infinitesimal body of water encounters leading portions 109, 111, that body of water is lifted upward by the generator hulls 113, 115, but due to the relatively low horizontal angle of orientation of the riding surfaces 131, 133, with respect to the direction of travel, that body of water is only slightly accelerated in the forward direction, and travels only slightly laterally, away from the center portion 103. The result is that a sheet flow of water 129, that flows onto the twin members 105, 107, is lifted upwardly, but not necessarily forwardly, and only slightly laterally, such that it flows relatively rearward, with respect to the forward moving device 101. Accordingly, rather than forming a curling wave shape, the device 101 displaces water to form a wake, or to enhance the boat's wake, forming solitary wave formations trailing behind the boat.

The device 101 is preferably between 2 to 5 feet wide and 3 to 15 feet in length. Because it is intended for high speed applications, the device 101 is smaller than the preferred embodiment, and, as discussed, creates less drag. The device 101 is also preferably relatively light-weight, so that it can be pulled by the boat 2 at high speeds. This embodiment is otherwise made from the same materials from which the preferred embodiment is made.

In use, as the wake enhancement device 101 is accelerated, the device 101 displaces water in such a way that creates, depending on the speed of the device, an enhanced wake, and/or other water formation, that trails behind the device. Similar to the preferred embodiment, the device moves through the water, and causes water to flow onto the twin members 105, 107. Water is then forced upward and rearward, relative to the device, forming water trajectories that eventually fall back into the surrounding body of water. At the same time, the displacement of water creates a wake that trails behind the device 101 in the water, upon which wake-boarding and/or other water skimming maneuvers can be performed. Generally, a rider is pulled by the boat, and can ride the wake, much like a water skier, or wake boarder, can ride the wake of the boat.

The device can be pulled from behind the boat 2 in a manner that enhances the wake being formed by the boat, by being positioned in the water so that it intercepts the boat's wake, amplifying and enhancing that wake, upon which wake-boarding, surfing, skimming and/or skiing maneuvers can be performed. A rider pulled by the boat can perform maneuvers around, over and/or through the enhanced wake formed by the device, as well as trick maneuvers, using the wake as a ramp, or launch platform, as discussed.

The Boat Hull Embodiment

Figure 8:
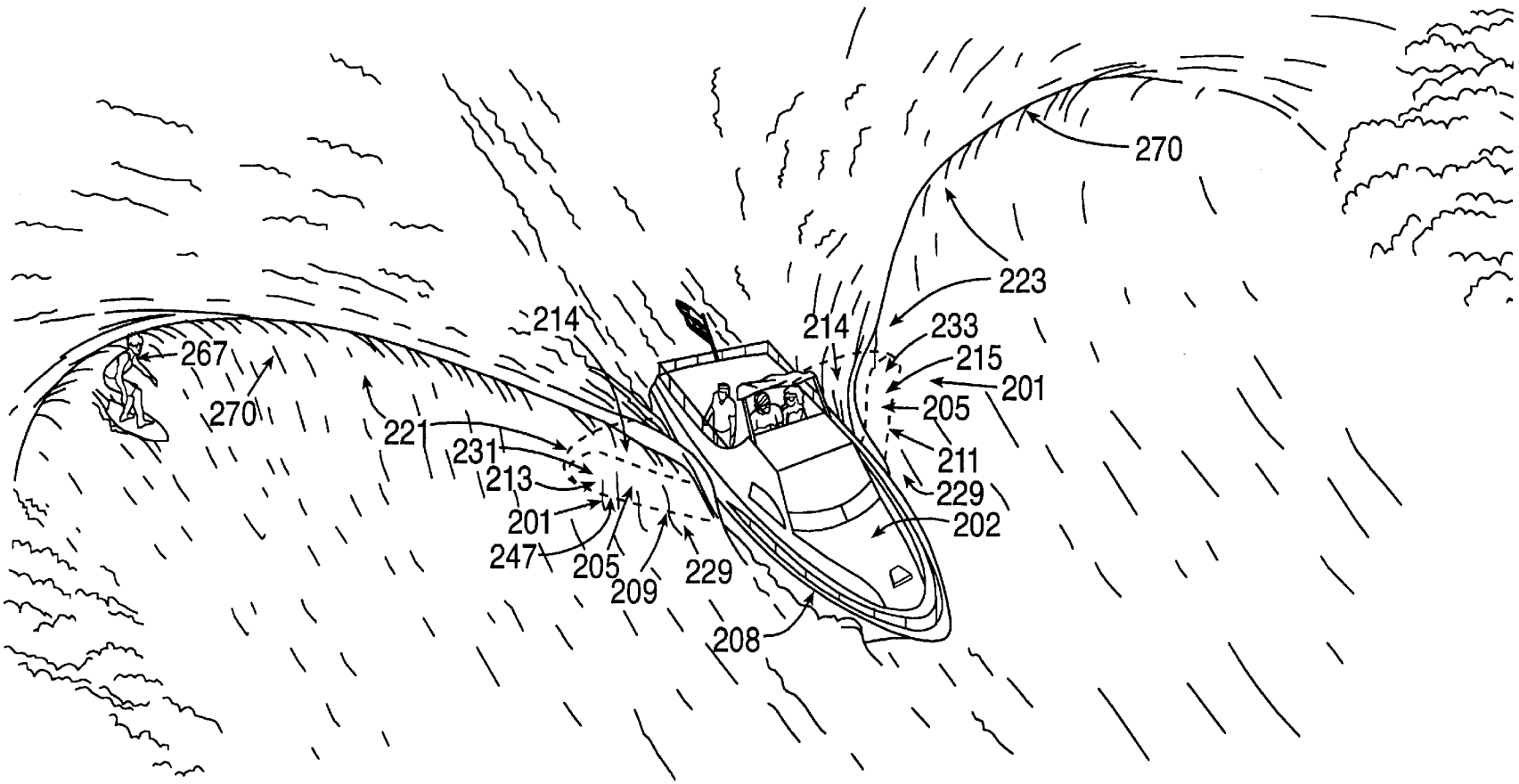
FIG. 8 is a perspective view of an embodiment attached directly to a boat hull in operation.

As shown in FIG. 8, the present invention can also be affixed to the hull 208 of the boat 202, such that as the boat travels through the water, the device 201 is pushed, rather than pulled. In this embodiment, twin members 205, 207 are attached to, or otherwise integrally formed with, the hull 208 of the boat 202, such that the twin members extend outwardly and laterally on either side of the boat. The device 201 can be positioned longitudinally along the side of the boat hull at the middle or back of the boat, although preferably, the device is attached at a location which would provide the most consistent and stable wave shapes, as will be discussed.

The twin members 205, 207 of this embodiment is similar in many ways to the twin members 5, 7 of the preferred embodiment, except that they are affixed to, or otherwise extend from, the boat hull. For instance, there are curved generator hulls 213, 215, leading portions 209, 211, and riding surfaces 231, 233, which are substantially configured as in the preferred embodiment. That is, the leading portions 209, 211 are positioned such that they cut through water to form a sheet flow 229, that flows onto the twin members 205, 207 and the generator hulls 213, 215, to form wave shapes 221, 223 thereon. The riding surfaces 231, 233 also have a concave curvature, horizontally and vertically, and extend rearwardly at an angle, as in the preferred embodiment, such that water flowing across the riding surfaces is accelerated forwardly, upwardly and laterally, away from the boat, as shown in FIG. 8.

Unlike the preferred embodiment, however, which is preferably maintained at a substantially constant depth in the water by virtue of its own weight, buoyancy, size and shape, this embodiment is secured to the side of a boat hull 208, and relies on the boat to keep the twin members 205, 207 in substantial equilibrium and at a substantially constant depth. The depth at which the twin members are positioned in the water is determined by the position of the twin members relative to the boat hull 208. Because the amount and consistency of water flowing onto the twin members will have a significant effect on the size and character of the wave shapes that are formed, the twin members are preferably mounted so that, during acceleration, the leading portions are consistently below the average surface level of the water. While a greater depth will cause more water to flow onto the twin members, creating larger wave shapes, it will also result in increased hydrodynamic drag, which may make it difficult for the boat to accelerate and maintain its speed.

In addition, the relative position of the boat with respect to the surface level of the water, and therefore, the amount of water that is allowed to flow onto the twin members, may vary depending upon the operating water surface conditions, the speed and acceleration at which the boat travels, and the position of the device with respect to the boat. That is, as the boat accelerates, the front end of the boat is likely to plane upward, while the back end of the boat is likely to fall slightly in elevation, due to the boat's forward momentum. This shift will, of course, have an effect on the relative position of the twin members in the water, and therefore, the proper mounting of the twin members will have to take into consideration its operating position, rather than merely its stationary position, in the water.

A bottom surface 247 of the twin members 205, 207 is preferably configured so that it creates little or no hydrodynamic effect, i.e., planing effect, which might affect the motion of the boat overall. For instance, the bottom surface can be horizontal, or even hollowed out underneath the riding surfaces, if desired, such that as the boat accelerates, the water will not create any upward effect on the device. On the other hand, in some instances, such as when the device is attached to the back of the boat, the bottom surface can be slightly forwardly inclined or substantially horizontal, which will help the boat stay stabilized, and keep from excessively planing, even during rapid acceleration. When the device is attached near the middle of the boat, however, it may be desirable to mount the device such that it cuts slightly into the water, rather than skimming or planing over it, which can offset the planing that would otherwise occur. Excessive planing by the boat is preferably avoided to maintain the leading portions 209, 211 of the device 201 at a substantially constant elevation in the water.

The device 201 is securely mounted onto the boat by any conventional means, such as by nut and bolt, or welding, but is preferably formed integrally with the boat hull 208. The device 201 is securely mounted to the boat, so that the device resists shear, bending and torsional forces, that may occur as the device moves through the water. A support 214 is provided on each twin member, behind the generator hulls, in the direction of travel, connecting the twin members to the boat hull. Because the device, in effect, is a horizontal cantilever on either side of the boat, it must resist the tendency of the water to cause substantial shear, bending and torsional forces on the device. The greatest shear, bending and torsional forces are exerted closest to the boat hull, and therefore, the support 214 at that location is preferably strengthened. Conversely, the least amount of force is exerted at the farthest tip of the device 201, and therefore, the support can be tapered towards the tip of each twin blade.

This embodiment can be made from substantially the same materials as the preferred embodiment. If the device 201 is integrally formed with the boat, however, it must be made from the same material as the boat hull. For instance, if the boat hull is made of fiber-glass, the device 201 should also be made of fiber-glass. A protective coating and soft padding, as in the preferred embodiment, should also be used in this embodiment to increase safety. The boat should also be strengthened in the area near where the device is affixed so that forces acting on the device will not adversely affect the boat hull.

The device 201 is preferably of a size and shape that is proportionate to the size, shape and power of the boat. The device 201 is preferably secured to the boat on the back half of the boat, as shown in FIG. 8, so that the wake caused by the front of the boat is incorporated into the wave shape formed by the device.

In use, the boat is accelerated to speeds sufficient to form suitable wave shapes 221, 223 on the generator hulls 213, 215. In this embodiment, the riders preferably ride on a wake 270 that extends from the wave shapes, rather than directly on the twin members, due to the danger of being too close to the boat during use. Accordingly, the boat preferably travels at speeds sufficient to form wake 270, of substantial size extending from the wave shapes, as shown in FIG. 8.

In this embodiment, it is preferable, but not necessary, that the rider(s) 267 maneuver into position in the water, rather than on the boat 202, so that as the boat passes by, the rider can, on his/her own, paddle in the same direction as the boat, and, can catch, and ride, the passing wave extending from the wake formed by the boat. Preferably, the driver of the boat coordinates the speed and direction of the boat, with the speed, direction and skill of the rider. Ideally, the rider will, with enough skill, be able to catch and ride the wave for an extended period of time.

Embodiment on Rails

The present invention can also be activated, or otherwise powered, by any conventional mechanical means, such as those that have been used to power a train, funicular, cable car, ski lift, trolley, etc., rather than a boat. For instance, the present invention can be positioned on rails attached to the bottom of a deep water environment, i.e., pool, so that it can be pulled by a rope or cable, creating wave formations on the surface of the pool, as substantially disclosed in U.S. Pat. No. 4,792,260, incorporated by reference above.

In one embodiment, two sets of twin members 5, 7 can be positioned back to back, so that one set faces one direction and another set faces another. In this fashion, the device can be positioned on a rail at the bottom of a pool of water, and then operated by a rope, pulling it through the water in one direction, creating wave shapes thereon, and then, in the opposite direction, creating additional wave shapes thereon. This will permit riders to go in one direction, and then ride back in the other direction, maximizing throughput.

What is claimed:

1. A device which can be mounted on or otherwise extended from the side of a boat hull, comprising:

two substantially longitudinally oriented members extending substantially laterally outward from the side of the boat hull, along substantially the middle and/or back half thereof, wherein each of said members comprises:

a forward leading portion;

a substantially curved flow forming portion extending rearward from said leading portion; and wherein the leading portion is positioned below the water surface such that, as the boat moves through the water, the leading portion helps to lift water upward and onto said flow forming portion, causing water to be displaced laterally outward and upward, such that various wave and/or wake effects are created thereby.

2. The device of claim 1, wherein the flow forming portion has surfaces that have curvatures in the horizontal and vertical directions.

3. The device of claim 1, wherein the device is separately formed and then mounted to an existing boat hull.

4. The device of claim 1, wherein the device is integrally formed with the boat hull.

5. The device of claim 1, wherein the flow forming portions have a concave curvature in the horizontal and vertical directions, such that as the boat travels through the water, water flows across the flow forming portions upwardly and laterally in relation to the boat hull.

6. The device of claim 1, wherein the bottom surface of said device is substantially horizontal.

7. The device of claim 1, wherein protective padding and coating are provided such that safety is increased.

8. A boat activated device, comprising:

two side members extending substantially laterally from the side of the boat hull, on substantially the back half thereof, wherein the side members extend longitudinally and laterally outward in relation to the boat hull, wherein each side member comprises:

an inclined front portion;

a rounded body portion extending rearward from the inclined front portion; and wherein the side members are oriented such that during the boat's operation the inclined front portion travels below the water surface and helps to lift water upward, wherein the front portion and body portion help to displace water laterally outward in relation to the boat hull, wherein various wave and/or wake effects are created thereby.

9. The device of claim 8, wherein the side members are mounted to the boat hull and extend laterally outward in opposite directions such that they increase the effective width of the boat hull for water displacement purposes.

10. The device of claim 8, wherein the side members extend laterally outward and rearward in relation to the boat hull at a predetermined angle.

11. The device of claim 8, wherein the side members are secured to the back half of the boat hull in a manner that causes the wakes naturally formed by the front of the boat to be incorporated into the wake effects formed by the device.

12. The device of claim 8, wherein the lifting effect created by the inclined front portion causes a reciprocal downward force to act on the boat, causing the boat to travel deeper in the water.

13. A boat for creating various wave and/or wake effects, comprising:

a boat hull;

two longitudinal sections extending substantially laterally outward on either side of the boat hull, on substantially the middle and/or back half thereof, wherein each section comprises:

a forward extending portion;

a body portion extending rearward from said forward extending portion; and wherein during the boat's operation the forward extending portion travels below the water surface and helps to push water upward, wherein the body portion helps to cause water to be displaced laterally in relation to the boat hull, wherein various wave and/or wake effects are created thereby.

14. The boat of claim 13, wherein the forward extending portion which travels below the water surface helps to push water upward, causing a reciprocal downward force to act on the boat.

15. The boat of claim 14, wherein the depth and position of the boat in relation to the water during operation is determined in part by the position of the longitudinal sections relative to the boat hull, and the downward force acting on the forward extending portion which causes the boat to travel deeper in the water.

16. The boat of claim 13, wherein the longitudinal sections can either be separately mounted to, or integrally formed with, the boat hull.

17. The boat of claim 13, wherein each of the longitudinal sections has a curved flow forming surface thereon, wherein as the boat is moved through the water, water is lifted up by the forward extending portion and onto said flow forming surfaces, such that various wave and/or wake formations are created thereby.

18. The boat of claim 13, wherein the force of the water being exerted upward creates a reciprocal downward force on said boat, which counteracts the upward force created by the planing effect caused by the boat as it moves substantially along the surface of the water, the combination of which help to keep the boat in substantial hydrodynamic equilibrium.

19. The device of claim 13, wherein the longitudinal sections extend laterally outward in opposite directions such that they increase the effective width of the boat hull for water displacement purposes.

20. A method for creating various wave and/or wake effects using a boat, comprising:

providing a boat with a boat hull, extending two flow altering side members from the side of the boat hull, one on each side of the boat, on substantially the middle and/or back portion thereof, wherein each of the side members has a forward extending portion and a body portion; and operating the boat in a body of water such that the forward extending portion substantially travels below the water surface and helps to lift water upward, and wherein the body portion helps to displace water laterally outward, such that various wave and/or wake effects are created thereby.

* * * * *